US005188551A

United States Patent [19]

Keller

[11] Patent Number: 5,188,551

[45] Date of Patent: Feb. 23, 1993

[54] MARKER BODY

[76] Inventor: Cyril N. Keller, Rte. 3, Box 405, Fergus Falls, Minn. 56537

[21] Appl. No.: 724,122

[22] Filed: Jun. 1, 1991

[51] Int. Cl.[5] ..... B63B 22/20

[52] U.S. Cl. ..... 441/6; 441/11; 441/23; 441/28

[58] Field of Search ..... 441/6, 11, 20, 21, 23, 441/26, 28

[56] References Cited

U.S. PATENT DOCUMENTS

| | | | |
|---|---|---|---|
| 706,803 | 8/1902 | Crouch, Jr. . | |
| 2,562,922 | 8/1951 | Kist . | |
| 3,037,217 | 6/1962 | Mandra | 441/20 |
| 3,626,528 | 12/1971 | Jackson | 441/6 |
| 3,653,085 | 4/1972 | Rovner . | |
| 4,443,203 | 4/1984 | Maertens | 441/22 |
| 4,544,364 | 10/1985 | Bankston | 441/6 |
| 4,976,641 | 12/1990 | D'Amico | 441/23 |

*Primary Examiner*—Sherman Basinger
*Attorney, Agent, or Firm*—Moore & Hansen

[57] ABSTRACT

A marker device for fishermen including a body or flotation portion made from a transparent, plastic bottle. A sheet of brightly colored fluorescent or retroreflective paper lines the inside of the bottle, making the marker highly visible. A threaded cap is secured to the core or bottom end of a spool, about which an anchor line is wound. The spool has upper and lower flanges, and the anchor line is secured to the upper flange. An anchor weight is secured to the free end of the anchor line, the anchor weight being a strip of malleable lead that may be formed to bend around the anchor line wound on the spool when not in use. Further, a counterweight is contained within the bottom portion of the spool opposite the bottle, causing the marker to stand upright in the water. After the marker has been set in the water and the anchor weight has sunk to the bottom of the lake or stream, the anchor line may be threaded through a slot in the lower flange of the spool, preventing additional anchor line from being paid out from the spool.

3 Claims, 2 Drawing Sheets

MARKER BODY

BACKGROUND OF THE INVENTION

1. Technical Field

The present invention relates generally to markers used to mark locations in bodies of water and more particularly to those, used by fishermen, that are desirably highly visible.

2. Background Information

The use of marker buoys for marking particular locations on lakes and rivers is well known among fishermen and others who may wish to return to, for example, a favorite fishing spot. Markers of this type usually include some means of flotation and a connecting means such as a line or chain connected to an anchor weight for maintaining the marker in the same position in spite of winds and currents. When the marker is thrown in the water from a boat, the anchor weight sinks to the bottom of the body of water, causing the line to unwind from the marker, until the anchor weight reaches the bottom of the body of water.

Many such markers, however, are difficult to locate once they have been positioned, because they require a large amount of surface area to remain afloat, and therefore must rest relatively low in the water. Some markers are painted with bright colors to make them easier to see. However, these markers are frequently left to bounce around in the bottom of a fishing boat when not in use, and the paint frequently chips or rubs off over a period of time. Further, many such markers lack a positive means for securing the line connected to the anchor weight in a position that maintains the marker close to the anchor weight, without permitting more line to be paid out from the marker due to wind, currents and waves. This may result in the marker, although still connected to the anchor weight, drifting a considerable distance from the point where it was left in the water. Tracing the line back to the anchor weight may cause inadvertent movement of the anchor weight, resulting in the loss of the location that was being marked Among these earlier marker buoys is one described in U.S. Pat. No. 4,443,203, issued to Maertens on Apr. 17, 1984. This reference shows a cylindrical marker that rests in the water in a generally upright position, although it initially rests on its side while it pays out line as the anchor weight sinks to the bottom. This reference also shows a separate line stop flange adjacent the line reel or spool.

Another reference representative of the state of the marker buoy art is U.S. Pat. No. 3,653,085, issued to Rovner on Apr. 4, 1972. This reference illustrates the dumbbell-shaped marker commonly used by many fishermen. This type of marker, which lies low in the water when in use, may be particularly difficult to find, especially in choppy water.

The marker buoy of the present invention overcomes the difficulties described above and affords other features and advantages heretofore not available.

SUMMARY OF THE INVENTION

The construction of the marker buoy is relatively simple, relying on readily available materials. In the preferred embodiment of the marker buoy, the body or flotation portion of the marker is a transparent plastic bottle, such as a pop bottle. A sheet of brightly colored fluorescent or retroreflective paper lines the inside of the bottle, making the marker highly visible. A threaded cap is secured as by glue or plastic molding material to the core or bottom end of a spool, about which an anchor line is wound. The spool has upper and lower flanges, and the anchor line is preferably secured to the upper flange. An anchor weight is secured to the free end of the anchor line, the anchor weight being a strip of malleable lead that may be formed to bend around the anchor line wound on the spool when not in use. Further, a counterweight is contained within the base portion of the spool opposite the bottle, causing the marker to stand upright in the water. After the marker has been set in the water and the anchor weight has sunk to the bottom of the lake or stream, the anchor line may be threaded through a slot in the lower flange of the spool, preventing additional anchor line from being paid out from the spool.

It is an object of this invention to provide a marking device of the type described that is inexpensive and relatively simple to fabricate. It is a further object of the invention to provide such a marking device that is easy and convenient to use. It is yet a further object of this invention to provide such a marking device that will remain near the sight being marked and be easily detected because of its bright coloration and upright posture in the water, making the marker more reliable and useful than those currently available.

Other objects and advantages of the invention will become apparent from the following detailed description and from the appended drawings in which like numbers have been used to describe like parts throughout the several views.

DESCRIPTION OF THE PREFERRED EMBODIMENTS

Figure 1:
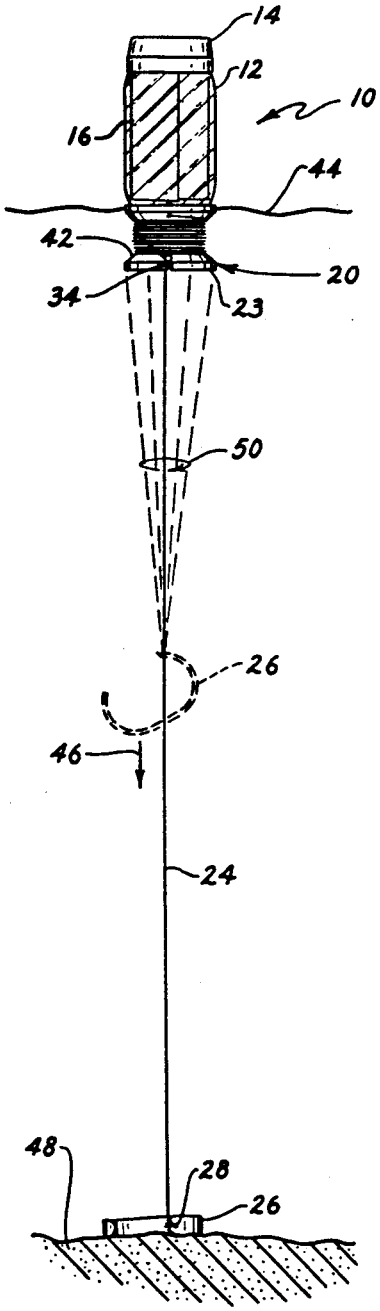
FIG. 1 is a side elevation of the marker buoy showing the marker on the water surface and with the anchor weight resting on the bottom of the body of water.

With reference to the drawings, and in particular to FIG. 1, the marker buoy of the present invention is generally indicated by reference numeral 10. Marker buoy 10 includes a hollow buoy body 12 having a body support 14. Buoy body 12 contains a brightly colored paper liner 16.

Figure 4:
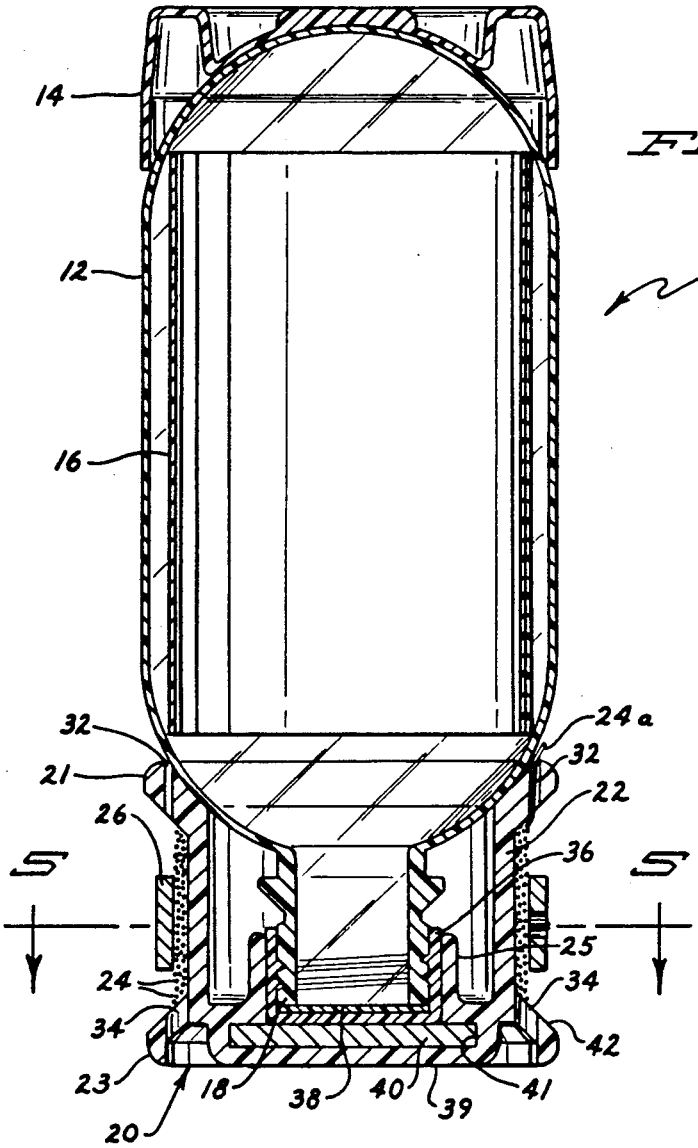
FIG. 4 is a section view taken along line 4—4 of FIG. 2.
Figure 5:
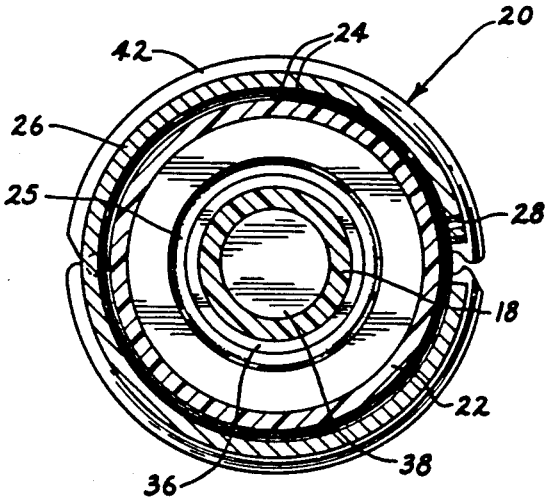
FIG. 5 is a section view taken along line 5—5 of FIG. 4.

As shown in FIG. 4, buoy body 12, which is preferably a conventional, elongated, cylindrical, transparent, plastic pop bottle, tapers to a threaded neck 18. Threaded neck 18, which constitutes the attachment portion of buoy body 12, is secured to a base including integral line receiving means, comprising a cylindrical base or spool 20. Spool 20 includes an upper spool flange 21, a spool body 22, and a lower spool flange 23. Anchor line 24 is wound around spool body 22 of spool 20, and contained between upper spool flange 21 and lower spool flange 23. Spool 20 is generally hollow, but includes an end wall 39 which serves as a bottom closure wall for the marker buoy assembly. Projecting inwardly from end wall 39 is an annular collar 25 that forms a recess matable with the attachment portion of buoy body 12. Threaded cap 36, having a cap liner 38, constitutes an internally threaded sleeve member, and is secured as by glue or plastic molding material inside the recess formed by annular collar 25. Spool 20 may thus be secured to buoy body 12 by threading threaded bottle cap 36 to threaded neck 18.

Figure 2:
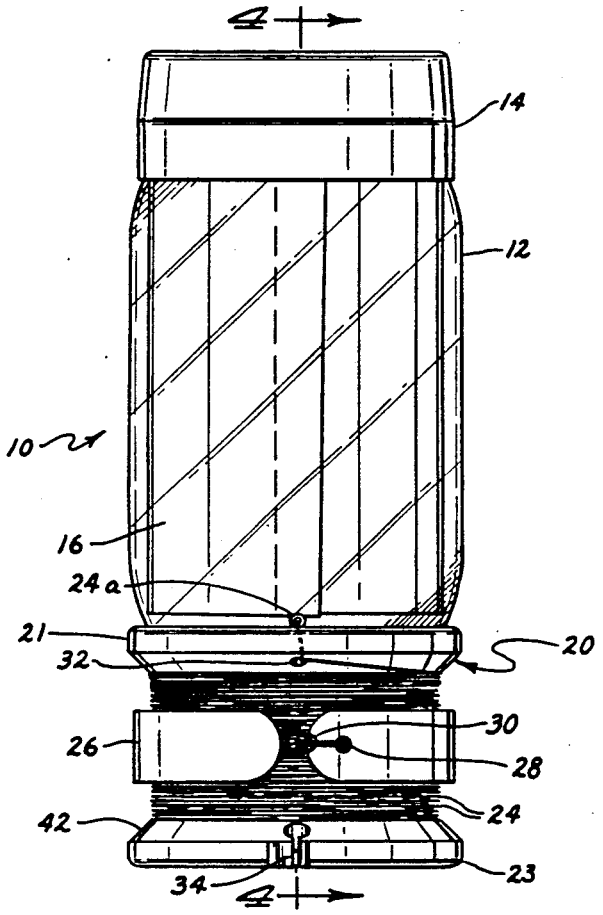
FIG. 2 is a side elevation of the marker buoy in a non-use condition, showing details of its construction.

Anchor line 24 is retained in position on spool 20 by means of a grommet 24*a* fastened to the end of line 24 that has been threaded through spool aperture 32 in flange 21. Instead of grommet 24*a*, a large knot may be tied in line 24 to prevent it from slipping through spool aperture 32, or another conveniently available item may be tied to the end of line 24. The other end of line 24 is tied to anchor weight 26. Anchor weight 26 is preferably a length of soft, malleable lead that may be easily bent to wrap around the anchor line 24 coiled around spool body 22, as illustrated in FIG. 2. Line 24 is passed through anchor aperture 28 and a loop is formed to fasten line 24 to anchor weight 26. A small notch 30 is provided on the end of anchor weight 26 to reduce the wear on anchor line 24.

A slot 34 is formed in lower flange 23 into which anchor line 24 may be inserted after anchor weight 26 has reached the bottom of a body of water, such as lakebed 48. Inserting anchor line 24 in slot 34 prevents more line 24 from being paid out from spool body 22. Lower flange 23 also includes a beveled surface 42 over which anchor line 24 travels when being paid out from spool body 22. Beveled surface 42 provides a surface with reduced friction to reduce the wear on line 24.

Figure 3:
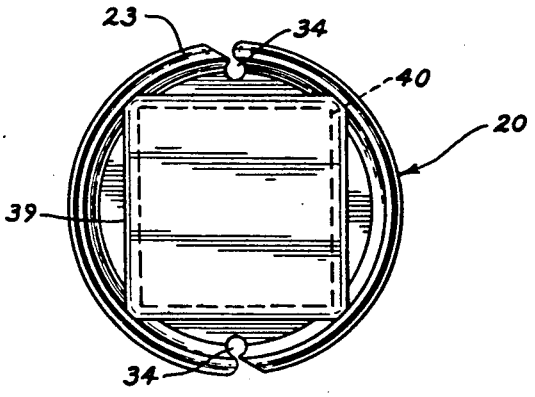
FIG. 3 is an end view of the marker buoy.

As illustrated in FIG. 3, bottom wall 39 is generally rectangular, and, as shown in FIG. 4, defines a recess 41 between threaded cap 36 and annular collar 25, on one side, and the bottom wall 39 on the other. Counterweight 40 is received and contained within recess 41 on the bottom end of the marker buoy, thereby maintaining buoy body 12 in a generally upright posture with respect to water surface 44. Counterweight 40 is preferably rectangular for snug containment within rectangular recess 41 of bottom wall 39.

In use, marker buoy 10 would be dropped onto water surface 4 after releasing anchor weight 26 from spool 20. Upon dropping marker buoy 10 onto water surface 44, marker buoy 10 assumes a generally upright position on water surface 44, due to counterweight 40 contained in the base of spool 20. As illustrated in FIG. 1, as anchor weight 26 drops in the direction shown by direction arrow 46 toward lakebed 48, anchor line 24 unwinds from spool 20 in the direction indicated by direction arrow 50. After anchor weight 26 reaches lakebed 48, anchor line 24 may be inserted into slot 34 to prevent the release of more line from spool 20.

While the preferred embodiments of the invention have been described, it should be understood that various changes, adaptations, and modifications may be made therein without departing from the spirit of the invention and the scope of the appended claims.

What is claimed is:

1. A marker buoy comprising:

a transparent, hollow body member of elongated, cylindrical shape having an attachment neck portion on one end thereof;

a line receiving spool of generally cylindrical configuration having an inner connection portion formed integrally therewith and containing connection means secured to said attachment neck portion of said hollow body member;

a bottom closure wall on said spool extending generally normal to the direction of extent of said neck portion of said hollow body member in closely spaced, opposing juxtaposition thereto;

a counterweight contained within said spool between said bottom closure wall and said inner connection portion of said spool, whereby said elongated body member assumes an upright position when floating on a body of water;

a length of line wound on said spool;

an anchor weight connected to the free end of said line; and a retroreflective sheet of material rolled inside of said body member coextensive with the side walls of said body member and inwardly spaced therefrom to enhance the visibility of said marker buoy.

2. A marker buoy comprising:

a hollow body member of elongated, cylindrical shape having an attachment neck portion on one end thereof;

a line receiving spool of generally cylindrical configuration having an inner connection portion formed integrally therewith and containing connection means secured to said attachment neck portion of said hollow body member, said spool having a bottom closure wall extending generally normal to the direction of extent of said neck portion of said hollow body member in closely spaced, opposing juxtaposition thereto, and said spool having an outwardly and downwardly flared flange on the end thereof most remote from said body member which is disposed adjacent to said bottom closure wall in embracing relation thereto, and at least one aperture extending through said flange to receive and guide line released from said spool;

a counterweight contained within said spool between said bottom closure wall and said inner connection portion of said spool, whereby said elongated body member assumes an upright position when floating on a body of water;

a length of line wound on said spool; and an anchor weight connected to the free end of said line.

3. A marker buoy as recited in claim 2 wherein:

said attachment neck portion of said body member and said connection means have mating threads thereon permitting removable, threaded attachment of said body member to said spool.

* * * * *

UNITED STATES PATENT AND TRADEMARK OFFICE

CERTIFICATE OF CORRECTION

PATENT NO. : 5,188,551

DATED : 2/23/93

INVENTOR(S) : Cyril N. Keller

It is certified that error appears in the above-identified patent and that said Letters Patent is hereby corrected as shown below: On the title page: Item [54] and Column 1, line 2, change "BODY" to --BUOY-- following "MARKER."

In column 1, line 2, change "BODY" to --BUOY-- following "MARKER."

In column 3, line 42, delete "4" and insert --44--.

Signed and Sealed this

Sixteenth Day of November, 1993

*Attest:*

*Attesting Officer*

Bruce Lehman

BRUCE LEHMAN

*Commissioner of Patents and Trademarks*